United States Patent [19]

Helms

[11] 4,145,151

[45] Mar. 20, 1979

[54] MANHOLE COVER AND FRAME WORK

[76] Inventor: William R. Helms, P.O. Drawer 918, Goldsboro, N.C. 27530

[21] Appl. No.: 891,866

[22] Filed: Mar. 30, 1978

[51] Int. Cl.[2] ..... E02D 29/14

[52] U.S. Cl. ..... 404/25; 52/20; 210/164

[58] Field of Search ..... 404/25, 26; 52/19, 20, 52/21; 210/163, 164

[56] References Cited

U.S. PATENT DOCUMENTS

| | | | |
|---|---|---|---|
| 889,051 | 5/1908 | Schodde | 210/163 |
| 1,191,497 | 7/1916 | Dauphinee | 404/25 X |
| 1,384,712 | 7/1921 | Shanley | 404/25 |
| 2,246,390 | 6/1941 | Smith | 210/164 X |
| 2,930,295 | 3/1960 | Hale | 404/26 |
| 3,237,538 | 3/1966 | McPheeters | 404/26 |
| 3,858,998 | 1/1975 | Larsson | 404/26 |

*Primary Examiner*—Nile C. Byers, Jr.
*Attorney, Agent, or Firm*—Fred Philpitt

[57] ABSTRACT

A method for inhibiting movement between a load bearing access device, such as a manhole cover or catch basin grate and its supporting framework which involves drilling a plurality of vertical passageways at spaced apart intervals adjacent to the circumference of said access device, said passageways also extending into said supporting framework, and fixing vertical studs in said passageways.

2 Claims, 10 Drawing Figures

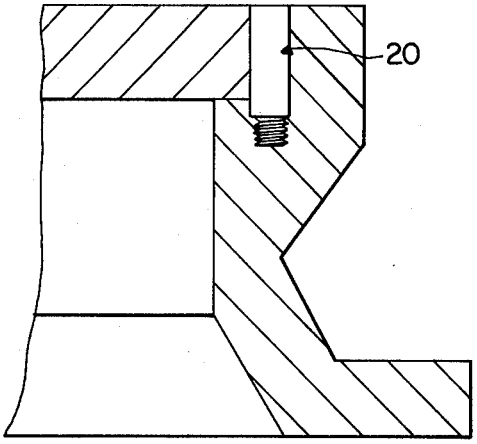
FIG. 7
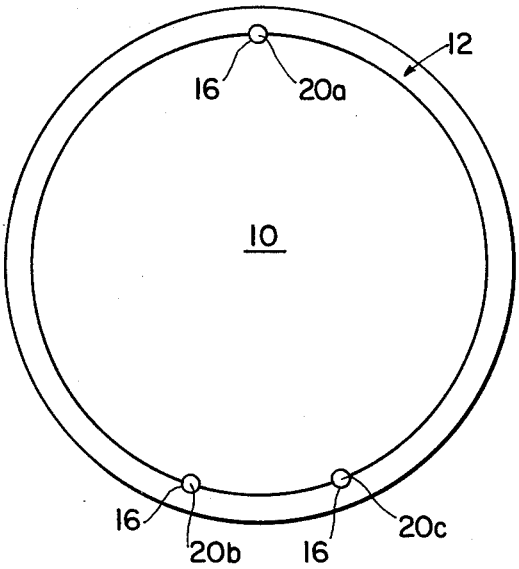
FIG. 8
FIG. 9
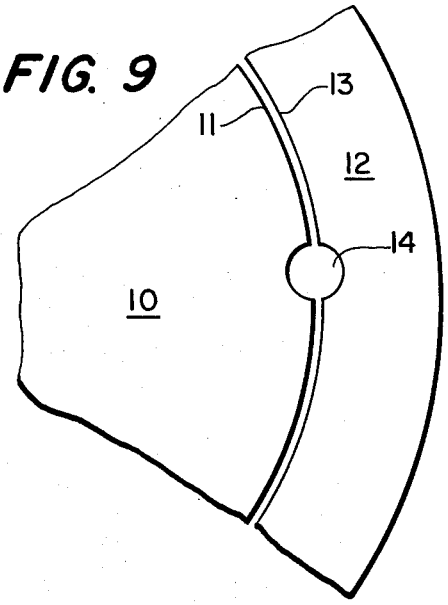
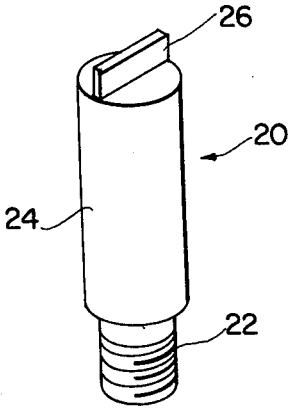
FIG. 10

MANHOLE COVER AND FRAME WORK

BACKGROUND

Nearly every urban street and roadway contains subsurface passageways that are covered by load bearing access devices, such as manhole covers. Each manhole cover is supported by a manhole frame. The outside diameter of the manhole cover is usually 0.25–0.40 inch less than the inside diameter of the supporting framework for the manhole cover which is necessary for easy removal and replacement. Dirt and water get in the space or gap between the cover and its supporting frame and function as a grinding medium to wear down those portions of the frame and cover that contact each other. Wear is accelerated when the spinning wheels of motor vehicles cause the cover to move or rock with respect to its supporting frame. As a result, some manholes in busy roadways wear down to an unacceptable degree in a short period of time.

Prior art workers have attempted to decrease the aforesaid type of wear by bolting the cover to the frame, but it has been found that there are several practical problems with this approach. A primary difficulty is that when workers have to enter such a manhole, they remove the bolts and then either lose them, forget them, or simply don't bother to replace them. Also, alignment of the bolt and bolt holes is often difficult and time-consuming.

A primary object of this invention is to provide a method and means for eliminating the relative movement between a manhole cover and its supporting frame in any practical sense.

THE INVENTION BROADLY

Considered from one aspect the present invention involves a method for inhibiting the movement of a manhole cover resting on the seat of a manhole frame and laterally restrained by an upstanding shoulder of the manhole frame, which method comprises (a) establishing plural vertical passageways at spaced apart intervals adjacent to the circumference of said cover, the circumferential periphery of each passageway encompassing both a portion of the outer periphery of said manhole cover and a portion of the inner periphery of the upstanding shoulder member of the manhole frame, the lower portion of each said passageway extending into the seat portion of the manhole frame and being at least partially threaded, (b) fixing a stud member having a lower end that is threaded into each said vertical passageway and into threaded interengagement with the said threaded lower portion of each said passageway, (c) modifying the upper end of each said stud member after it has been threadably interengaged with said threaded lower portion of each said passageway so that said stud members cannot be readily disengaged.

THE DRAWINGS

FIGS. 1–7 are fragmentary cross-sectional views of a manhole cover and its supporting frame as it undergoes the steps involved in the present invention;

FIG. 8 is a plan view of a manhole cover, its supporting frames, and in-place studs in accordance with this invention.

FIG. 9 is a fragmentary plan view of a manhole cover, its supporting frame and a passageway in accordance with this invention.

FIG. 10 is an isometric view of a stud member useful in connection with the present invention.

THE INVENTION SPECIFICALLY

Figure 1:
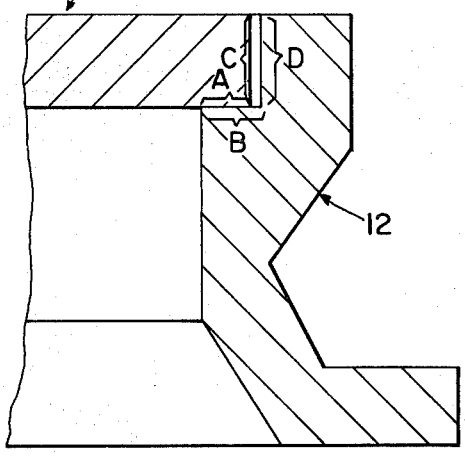

FIG. 1 shows the conventional arrangement of a manhole cover 10 and a manhole supporting frame 12. Both cover 10 and frame 12 have been shown in very simplified form. The top surface of the manhole cover 10 is shown as being level with the upper surface of the support frame 12. The outer lower surface A of the cover 10 rests on the seat portion B of the support frame 12. The outer side surface C of the cover 10 parallels the inner shoulder surface D of the support frame 12, and surfaces C and D may be machined to achieve the desired clearance or distance between surfaces C and D.

Figure 2:
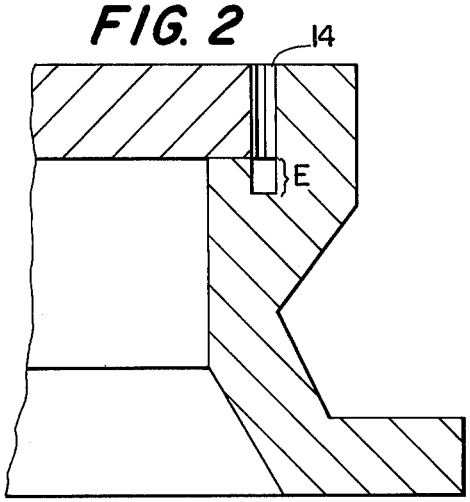

In accordance with the invention, a preferred first step is to place the cover 10 in the support frame 12 and to fix it centrally therein by means of several small wedges inserted at spaced apart points between surfaces C and D. Once the cover is centered and held in place, a hole 14 is drilled downwardly through both the cover 10 and the frame 12 and for a limited distance E and then downwardly into the seat portion B of the support frame 12 (see FIG. 2 and FIG. 9). As can be seen most clearly in FIG. 9, the circumferential periphery of the hole 14 encompasses both a portion of the outer periphery 11 of said manhole cover 10 and a portion of the inner periphery 13 of the shoulder of the support frame 12.

Figure 3:
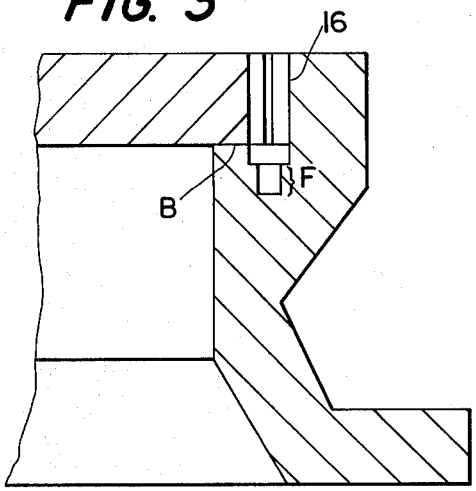

Hole 14 is considered as a lead hole or guide hole for subsequent counterboring. FIG. 3 shows that by counterboring hole 14 with a larger drill (e.g. a 1.25 inch drill) a vertical passageway 16 of enlarged diameter is formed. Counterboring does not extend completely to the bottom of hole 14, so that a portion F of the original hole 14 remains after counterboring. FIG. 3 shows that the counterboring extends downwardly below the seat B. However, if desired, the counterboring can end at the seat B. The circumference of passageway 16 encompasses both a portion of the outer periphery 11 of the manhole cover 10 as well as a portion of the inner periphery 13 of the shoulder of the support frame 12.

Figure 4:
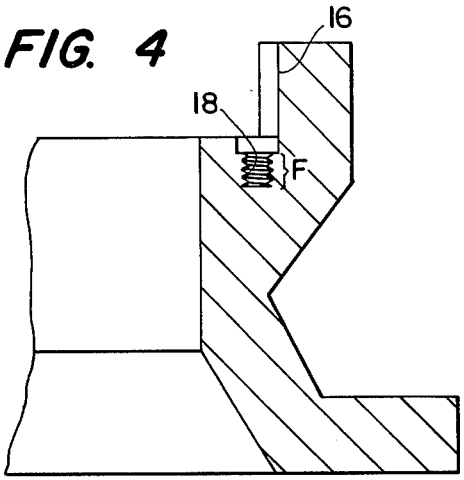
Figure 5:
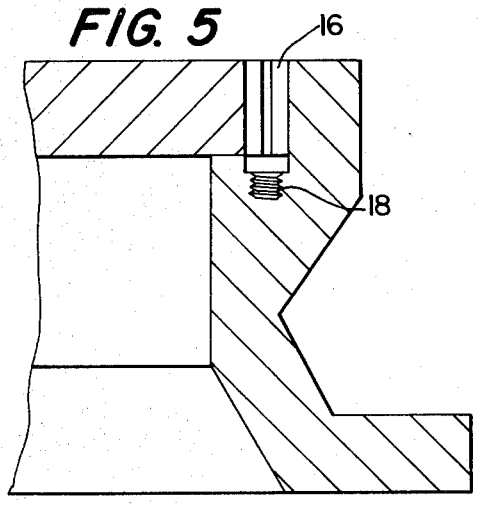
Figure 6:
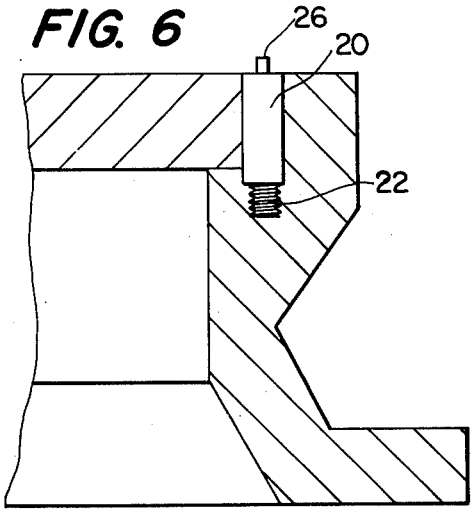

Next, the cover 10 is removed and the aforesaid portion F of passageway 16 is threaded, as is indicated by 18 in FIG. 4. The cover is then replaced (see FIG. 5) making sure that the alignment of the passageway 16 in the cover 10 and frame 17 returns to that which is shown in FIG. 3 so that the passageway 16 is ready to receive a stud of the type shown in FIG. 10. As can be seen in FIG. 10, the stud 20 (preferably made of stainless steel) has a lower threaded end 22, an intermediate body portion 24 and an upper stud turning means 26. The stud 20 is inserted in the passageway 16 and rotated by turning means 26 until the threaded portion 22 of the stud engages the threaded portion 18 of the passageway 16, as is illustrated in FIG. 6. The stud turning means 26 is then removed in any desired manner (e.g. grinding) so that the stud 20 cannot thereafter be readily rotated and removed by workmen. After removal of the means 26 the top surface of the stud 20 is preferably essentially level with the surface of the cover 10, as is shown in FIG. 7. The body portion 24 of the stud member 20 is preferably almost the same diameter (i.e. 1.25 inch) as the passageway 16 (i.e. 1.25 inch) so that little or no clearance is left between them.

FIG. 8 illustrates the preferred embodiment of the invention which contains three spaced apart passageways 16 and three studs 20*a*, 20 *b* and 20*c*. Studs 20*b* and 20c are about 165° from stud 20a and about 30° from each other. More than three passageway-stud arrangements could be used, or less than three, but I have found three to be superior both from the standpoint of utility and economy.

When it becomes necessary to remove the manhole cover, workmen place lifting tools into rings or notches located in the upper suface of the cover (which are so conventional that they are not shown in the drawings) and lift upwardly. The cover slips upwardly and disengages from the studs 20a, 20b and 20c. When the workmen are ready to replace the manhole cover (which often weighs more than 300 pounds) they can slide it along the street surface until the two semicircular drilled-out portions of the cover 10 abut against the studs 20b and 20c (see FIG. 8). Studs 20b and 20c thereby in effect "index" the cover into correct placement with respect to the support frame 12. This indexing automatically aligns the other semicircular drilled-out portion of the cover with stud 20a. If the cover 10 doesn't then simply fall into its correct position with respect to the support frame and the studs, it will do so when workmen place lifting tools into the aforesaid rings or notches in the upper surface of the cover, lift upwardly and then drop the cover down past the studs.

The concept of providing "half-holes" through the outer edge of the cover is much better than simply having a circular hole in the cover because half-holes make it much easier for workers to line up or "index" the cover with the studs when replacing a manhole cover. Also, the non-removability of the studs avoids the shortcomings of the prior art attempts to hold down covers with bolts that can be removed and misplaced or lost. The fact that the frame contains a "half-hole" is advantageous in that the frame thereby helps support the stud in a vertical position. The fact that the stud is always half enclosed by the frame increases the difficulty of removing the stud.

The present invention insures that once a cover and a supporting frame are machined to fit each other with the desired minimum clearance, the use of the spaced apart passages and studs in accordance with this invention will guarantee that the cover will always go back in exactly the same position and will not be askew to such an extent that the previously careful machine was useless.

In the foregoing discussion a particular sequence of steps have been set forth for illustrative purposes. However, those skilled in this art will readily appreciate that this sequence can be modified in a number of ways and the objectives of the invention still attained. For example, it may be possible to omit drilling the guide hole 16 and to initially drill hole 16. It might also be possible to drill the cover and frame separately, but great care and accuracy would be required.

Although the surface D of the support frame has been shown as being perfectly vertical, I have found it desirable to have about a 2.5 degree slope in both surfaces C and D so as to facilitate removal and replacement of the manhole cover.

The stud can be made of a tough durable plastic material (such as polyvinylchloride) rather than stainless steel, if desired.

The load-bearing access devices to which the present invention is applicable includes manhole covers, catch basin grates, valve box covers, junction box covers, trenchway grates, monument covers, and any and all such access devices by whatever name which are used in conjunction with a supporting frame member embedded in or through a paved thoroughfare and supported by a foundation either in or below the paved thoroughfare for the purpose of supporting vehicular traffic loading and which are removable to provide access to underground structures or operational devices or conduits or sluiceways or sandtraps located below the top surface of the paved thoroughfare. These access devices, together with their supporting frames, may be round, oval, square, rectangular, triangular or any other geometric plane configuration. Because a manhole cover is probably one of the best known and most widely used load-bearing access devices, the drawings and the following detailed description are directed to a manhole cover as the load-bearing device, and it should be understood that this has merely been done for exemplary purposes and not by way of limitation.

In conclusion, while the foregoing specification and drawing describe the construction, operation, and use of one preferred embodiment of the instant invention, it is to be understood that I do not intend to limit myself to the precise constructions and arrangements herein disclosed, since the various details of construction, form and arrangement may obviously be varied to a considerable extent by anyone skilled in the art without really departing from the basic principles and novel teachings of this invention and without sacrificing any of the advantages of the invention, and accordingly it is intended to encompass all changes, variations, modifications and equivalents falling within the scope of the appended claims and the doctrine of equivalents.

I claim:

1. A method for inhibiting the movement of a load bearing access device resting on the seat of a supporting frame and laterally restrained by an upstanding shoulder member of the supporting frame, which method comprises (a) establishing a plurality of vertical passageways at spaced apart intervals adjacent the circumference of said access device, the circumferential periphery of each passageway encompassing both a portion of the outer periphery of said access device and a portion of the inner periphery of the upstanding shoulder member of the supporting frame, the lower portion of each said passageway extending into the seat portion of said frame and being at least partially threaded, (b) fixing a stud member having a lower end that is threaded into each said vertical passageway and into threaded interengagement with the said threaded lower portion of each said passageway, (c) modifying the upper end of each said stud member after it has been threadably interengaged with said threaded lower portion of each said passageway so that said stud member cannot be readily disengaged.

2. In the known combination of a load bearing access device and a supporting frame for said device, said frame including a seat portion upon which the outer lower surface of said access device rests and a generally vertical shoulder portion having an inside diameter slightly greater than the outside diameter of said access device, the improvement which conprises (a) said access device containing a plurality of spaced apart vertical passageways adjacent its circumference the circumferential periphery of each passageway encompassing both a portion of the outer periphery of said access device and a portion of the inner periphery of said shoulder portion, the lower portion of each said passageway extending into the seat portion of the supporting frame and being at least partially threaded, (b) a stud member in each passageway having (1) a lower end that is threaded engaged with the threaded lower end of each passageway and (2) an upper end that is level with the upper surface of said access device.

* * * * *